United States Patent [19]

Decker

[11] Patent Number: 4,690,622

[45] **Date of Patent: * Sep. 1, 1987**

[54] LIQUID INTENSIFIER UNIT

[75] Inventor: Robert W. Decker, Stewartsville, N.J.

[73] Assignee: Ingersoll-Rand Company, Woodcliff Lake, N.J.

[ * ] Notice: The portion of the term of this patent subsequent to Nov. 11, 2003 has been disclaimed.

[21] Appl. No.: 893,952

[22] Filed: Aug. 7, 1986

Related U.S. Application Data

[63] Continuation of Ser. No. 776,463, Sep. 16, 1985, Pat. No. 4,621,988.

[51] Int. Cl.[4] ..... F04B 35/02

[52] U.S. Cl. ..... 417/342; 417/347

[58] Field of Search ..... 417/342, 347

[56] References Cited

U.S. PATENT DOCUMENTS

| | | | |
|---|---|---|---|
| 847,394 | 3/1907 | Beck et al. | 417/533 X |
| 1,295,511 | 2/1919 | Jernberg | 417/533 |
| 3,234,882 | 2/1966 | Douglas et al. | 417/342 X |
| 3,295,451 | 1/1967 | Smith | 417/347 X |
| 3,367,272 | 2/1968 | Smith | 417/342 |
| 3,481,587 | 12/1969 | Ruhnau | 417/342 X |
| 4,500,267 | 2/1985 | Birdwell | 417/342 X |
| 4,621,988 | 11/1986 | Decker | 417/342 |

FOREIGN PATENT DOCUMENTS

| | | | |
|---|---|---|---|
| 1470956 | 4/1977 | United Kingdom | 417/339 |
| 1,599,411 | 9/1981 | United Kingdom | 417/347 |

*Primary Examiner*—Leonard E. Smith

*Attorney, Agent, or Firm*—Bernard J. Murphy

[57] ABSTRACT

The unit comprises three liquid intensifiers, coupled together in juxtaposition, and fixed between a pair of plates. A support plate at the one end of the intensifiers mounts a rotary valve which, sequentially, supplies operative, low-pressure fluid to the intensifiers. A base plate at the other end of the intensifiers admits liquid into each thereof, for pressure intensification of the liquid by the intensifiers, and provides a common outlet aperture for the pressurized liquid.

3 Claims, 18 Drawing Figures

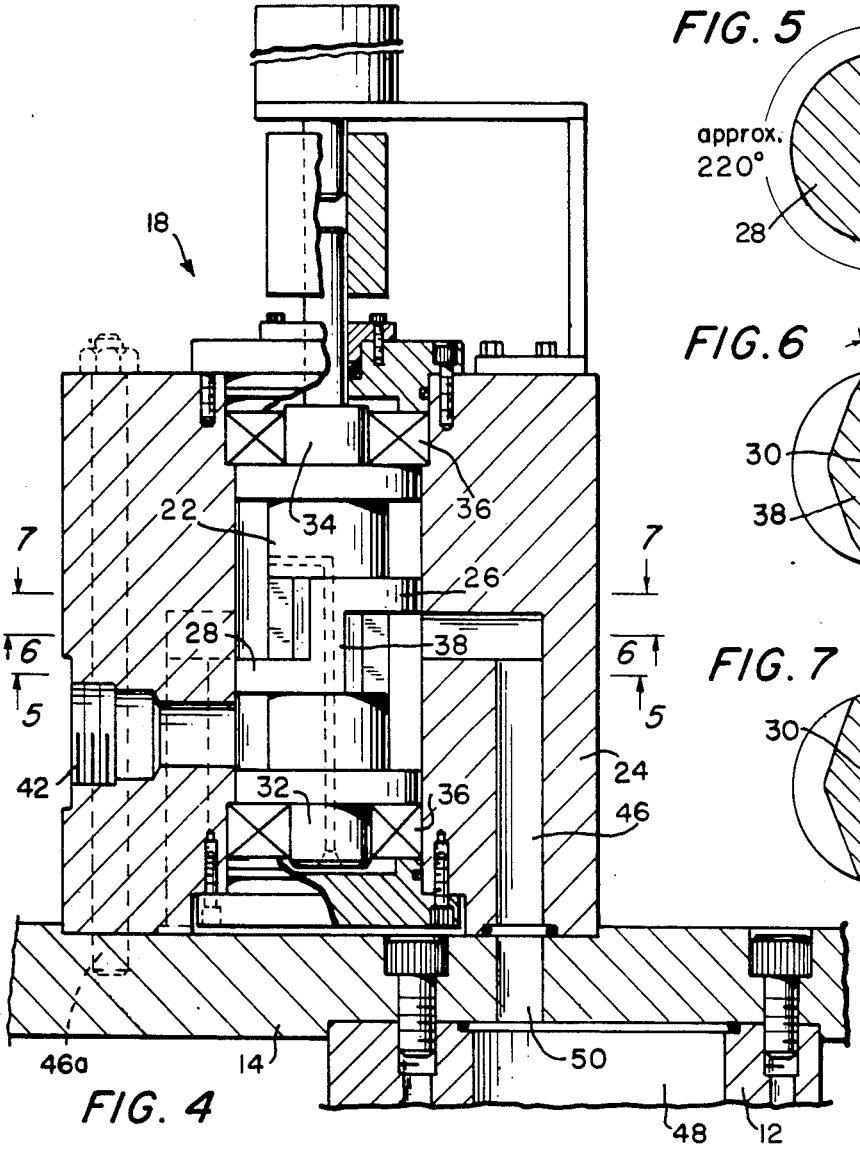
FIG. 4
FIG. 5
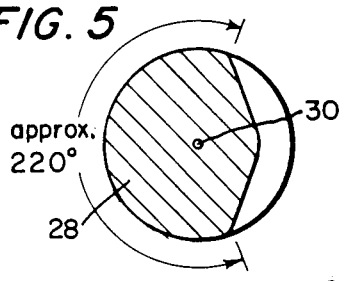
FIG. 6
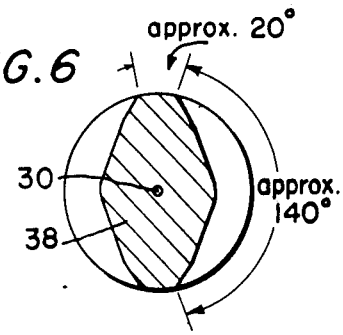
FIG. 7
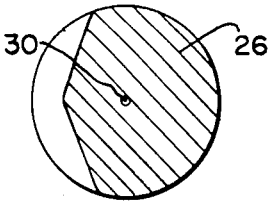
FIG. 8
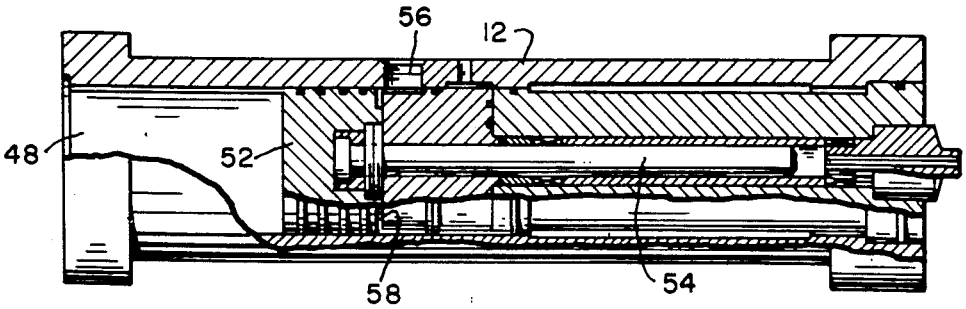

LIQUID INTENSIFIER UNIT

This is a continuation of application Ser. No. 776,463 filed Sept. 16, 1985 now U.S. Pat. No. 4,621,988.

This invention pertains to liquid pumps, liquid intensifiers, and the like, and in particular to a liquid intensifier unit especially adapted for use in water jet cutting systems.

High pressure pumps or intesifiers employed in operations such as water jet cutting, manifest pulsations. As a consequence thereof, there are formed irregularities or undulations in the jet-cut path due to such pulsations. To minimize this, it has been proposed that a plurality of intensifiers should be employed in a packaged unit, the intensifiers thereof being cooperatively coupled together by appropriate piping, conduits and valving to effect sequential and repetitive operation of the so-coupled intensifiers. However, such piping, conduitry and valving arrangements as are commonly employed in such manifolding assemblies of very high pressure components would introduce other technical problems at least as severe as those presented by the pulsations sought to be overcome.

It is an object of this invention, then, to set forth a novel liquid intensifier unit which minimizes the aforesaid pulsations, and which does not present the piping, conduit and valving difficulties cited.

It is an especially an object of this invention to set forth a liquid intensifier unit comprising a plurality of elongate, liquid intensifiers; and first means fixing said intensifiers together in juxtaposition; wherein each of said intensifiers has a first, common opening at one end thereof for both admitting thereinto, and discharging therefrom, respectively, an operating, low-pressure fluid; each of said intensifiers further has a second, common opening at the other, opposite end thereof for both admitting thereinto, and discharging therefrom, respectively, a subject liquid for pressure intensification of such liquid by such each intensifier; each of said intensifiers also has a given, variable-volume chamber formed therewithin for receiving therewithin, and expelling therefrom, an operating liquid; and further including second means effecting a common, fluid communication said given, variable-volume chambers only with each other for conducting operating liquid, expelled from such a given, variable-volume chamber of one of said intensifiers, to said given, variable-volume chamber of another of said intensifiers; and valving means, coupled to said intensifiers for admitting an operating, low-pressure fluid to, and for discharging the same, said, low-pressure fluid from, said first, common opening of each of said intensifiers, in turn, and repetitively; wherein each of said intensifiers further has a low-pressure piston therewithin movable in first and second, opposite directions; and said valving means and said second means comprise means cooperative for moving one of said low-pressure pistons, in one of said intensifiers, in one of said first and second directions, at a given velocity, in response to a movement of another low-pressure piston, in another of said intensifiers, in the other of said first and second directions, at a velocity differing from said given velocity.

Further objects of this invention, as well as the novel features thereof, will become more apparent by reference to the following description, taken in conjunction with the following FIGS. in which:

FIG. 4 is a cross sectional view of the valve taken along section 4—4 of FIG. 3;

Figure 10:
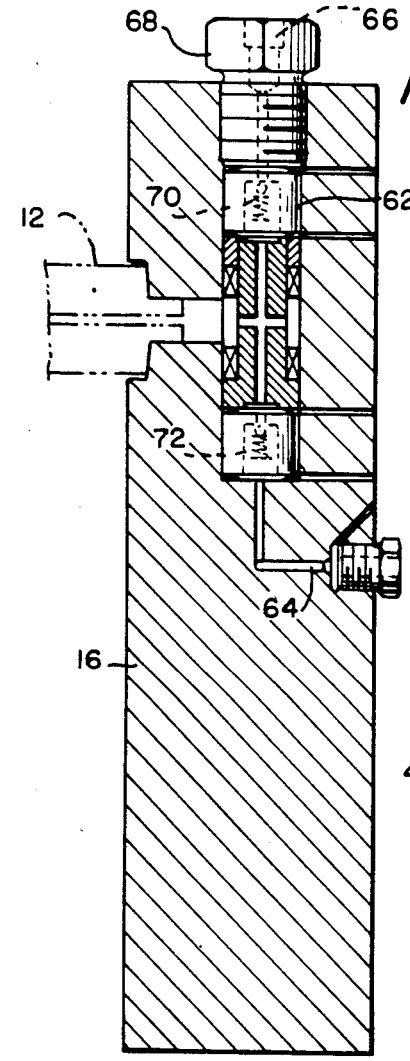
Figure 9:
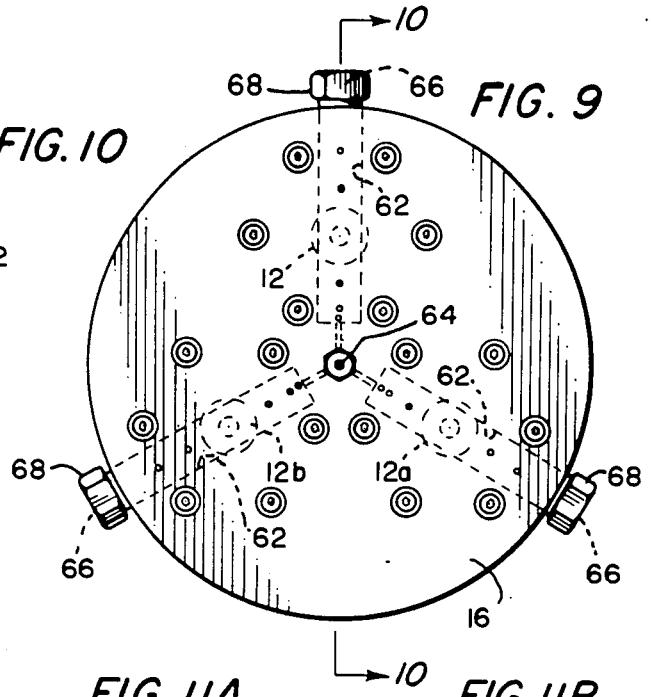

FIGS. 5, 6, and 7 are cross-sectional views taken from cross-sections 5—5, 6—6, and 7—7 respectively, in FIG. 4;

FIG. 8 is a cross-sectional view taken along the central axis thereof, one of the intensifiers;

FIG. 9 is a plan view of the base plate which receives the discharge ends of the intensifiers;

FIG. 10 is a cross-sectional view taken along section 10—10 of FIG. 9; and FIGS. 11A through 11H are sequencing illustrations depicting the operation of the rotary valve with respect to the three intensifiers.

Figure 11A:
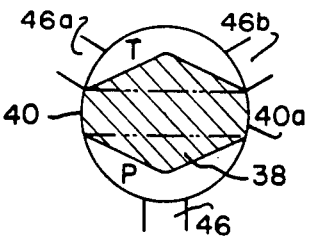
Figure 11B:
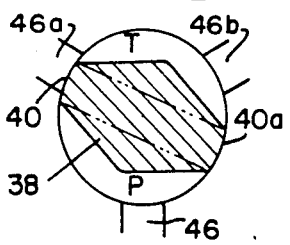
Figure 11C:
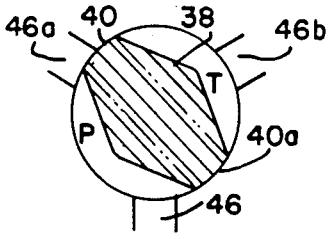
Figure 11D:
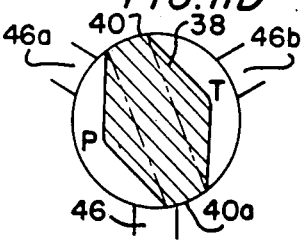
Figure 11E:
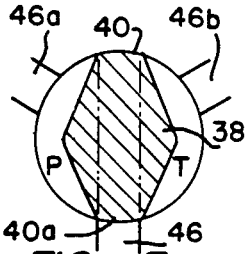
Figure 11F:
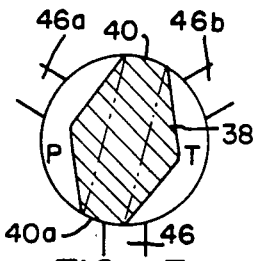
Figure 11G:
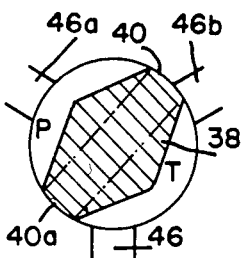
Figure 11H:
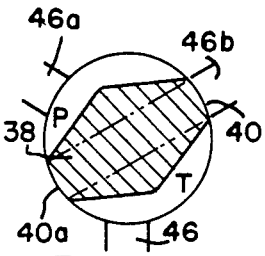

As shown in the figures, the novel intensifier unit 10 comprises three identical intensifiers 12, **12*a* and 12*b* coupled together in juxtaposition by means of a support plate 14 at one end, and a base plate 16 at the other. Fixed to the support plate 14 is a rotary valve 18 driven by a hydraulic motor 20 which rotates a valving rotor 22 within a valve housing 24. The rotor 22 has a pair of lands 26 and 28 spaced apart from each other, the lands extending radially on opposite sides of the rotary axis 30 of the rotor. Each of the lands 26 and 28 subtends an arc of approximately two hundred and twenty degrees. Ends 32 and 34 of the rotor are journaled in bearings 36 supported in the housing 24. Intermediate the lands 26 and 28, the rotor 22 has a shank portion 38 with radially extended, oppositely disposed lobes 40 and 40*a* which occupy arcs of approximately twenty degrees. Adajacent to one end of the valve housing 24 is a port 42 for admitting hydraulic fluid under pressure into the central bore of the housing, and a second port 44 adjacent to the opposite end of the valve housing is provided for discharging the aforesaid hydraulic fluid therethrough for return to a reservoir. Opening into the housing, and midway therealong, are three conduits 46, 46*a*, and 46*b* which further extend, through the housing, to one end thereof. The latter conduits are provided for admitting and discharging hydraulic fluid to and from the three intensifiers 12, 12*a* and 12*b*. During normal operation of the unit 10, hydraulic fluid is supplied constantly, under pressure, to the port 42 of the valve 18, and the discharge port 44 is always open to a reservoir (not shown). Accordingly, as the hydraulic motor 20 rotates the rotor 22 the hydraulic fluid under pressure is admitted to each of the intensifiers 12, 12*a* and 12*b* in turn. As FIGS. 4 through 7 evidence, the rotor 22, its lands 26 and 28, its shank portion 38, and the relative positions of ports 42 and 44 cooperate: (a) to apply the full supply of pressured hydraulic fluid to one of the intensifiers 12, 12*a* and 12*b*, or a shared supply thereof to two of the intensifiers, and (b) to connect two of the intensifiers to the reservoir (via port 44) or only one to the reservoir, respectively. The sequence illustrations FIGS. 11A through 11H show this. In FIG. 11A conduit 46 is supplied the pressured hydraulic fluid "P", from port 42, solely. Consequently, the piston 52 of the communicating intensifier is driven in a power stroke at a given acceleration. Conduits 46*a* and 46*b* are in shared communication with the reservoir (or tank "T"). The communicating other intensifiers, then, have their pistons 52 retracting at half said acceleration. With rotation of the rotor 22 to the FIG. 11B position, shank portion 38 disposes its lobe 40 in closure of conduit 46***a;* hence only conduit 46*b,* then, is left in communication with the reservoir. The piston 52 of the associated intensifier, therefore, will continue retracting -- but now at the aforesaid given acceleration. By the time the shank portion 38 has come to the dispositions of FIGS. 11C and 11D, the conduits 46 and 46*a* are sharing the operating hydraulic fluid from port 42, and the pistons 52 of the communicating intensifiers move in power strokes at but half the aforesaid given acceleration.

Figure 1:
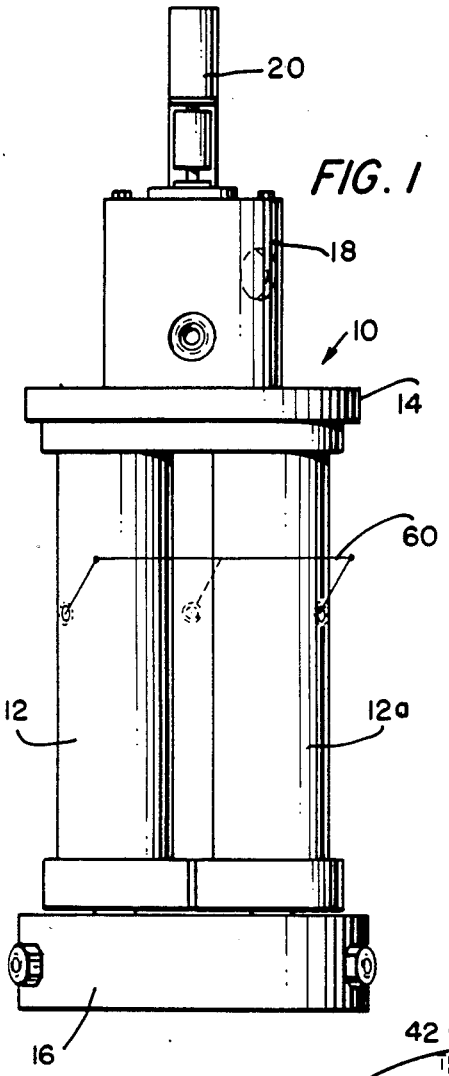
FIG. 1 is a side elevational view of an embodiment of the invention.
Figure 2:
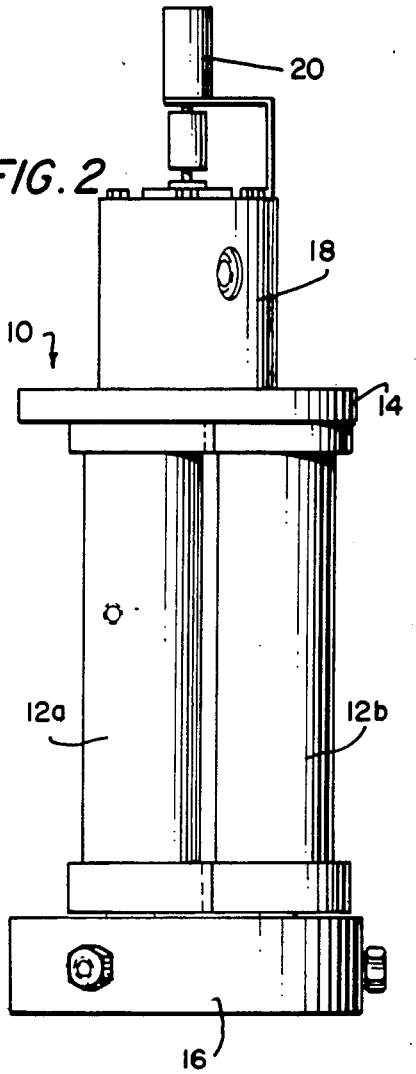
FIG. 2 is an elevational view of the embodiment of FIG. 1 taken from the right hand side of FIG. 1.
Figure 3:
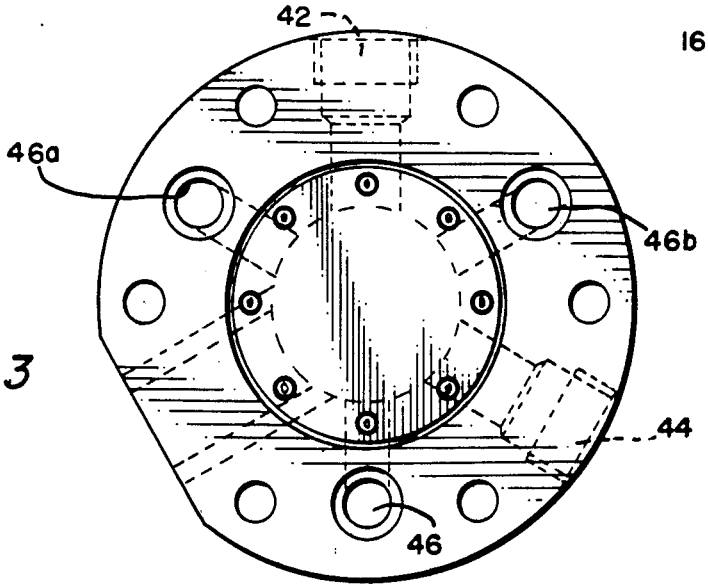
FIG. 3 is a view of an end of the rotary valve used to control and sequence the intensifier unit, the same showing that end thereof which is coupled to a support plate.

Each intensifier, intensifier 12 as depicted in FIG. 8 being representative, has an open end 48 which is fastened to the support plate 14. In turn the support plate 14 has three channels 50 formed therethrough to communicate the conduits 46, 46*a* and 46*b* with the open ends 48 of the intensifiers. Each intensifier has a large, low-pressure piston 52 and a small, high-pressure piston or plunger 54 connected thereto, quite as is known in the prior art. The latter, of course, is used to intensify the pressure of the subject fluid. Intermediate the length of the intensifier is formed a port 56 which is provided for a hydraulic communication in common with the other two intensifiers (12*a,* 12*b*) in the unit 10. That is to say that beneath the low-pressure piston of each intensifier there is formed a return, variable-volume chamber 58 which is commonly manifolded with the other variable-volume chambers 58 of the other intensifiers, by a manifold 60 shown only schematically in FIG. 1. Therefore, when any given intensifier translates its low-pressure piston 52 toward its far, discharge end, it expels fluid from its variable-volume chamber 58 to the other intensifiers. As a consequence thereof, this causes a retraction of the pistons 52 in the other intensifiers. It is in this way that each intensifier piston 52 (and 54) is returned or retracted to its starting position by the forward or powered strokes of its companion, low-pressure pistons 52.

The manifold 60 and the variable-volume chambers 58 together define a given and fixed fluid capacity. The chambers 58 and manifold 60 are charged with hydraulic fluid so as to insure that, as a given piston 52 is displaced by the hydraulic fluid directed thereto via a channel 50 and port 42, such piston 52, in turn, expels hydraulic fluid via the corresponding intensifier's port 56, and the expelled fluid, via manifold 60, causes one or both of the other pistons 52 to retract. The expelled fluid enters the port(s) 56 of the one (or both) piston(s) as the rotary positioning of the shank portion 38 of the rotor 22 will allow.

FIGS. 9 and 10 disclose the novel base plate 16 to which each of the intensifiers 12, 12*a,* 12*b* is coupled through the lower discharge ends thereof. FIG. 10 shows only the discharge end of only one of the intensifiers engaged therewith. The plate 16 has three channels 62 formed therewithin, one hundred and twenty degrees apart, and all three converge and join in the center where there is an aperture 64 formed for the discharge of the intensified fluid. Ports 66 formed in threaded plugs 68 threaded into tapped holes in the outer periphery of the plate each open onto each one the channels and, therethrough, supply the liquid which is to be intensified. As a plunger 54 retracts, it draws liquid from the port 66 (from a supply not shown) into the intensifier. Then, as the plunger 54 is driven by its coupled low-pressure piston 52, the liquid has its pressure greatly amplified and it is forced through the channel 62 provided therefor to the central aperture 64 in the plate 16. Each intensifier in turn, then, discharges its high-pressure liquid through its respective channel 62 in the plate 16 to the central, common aperture 64. Check valves 70 and 72 prevent a reverse flow of liquid through port 66, and orifice 64, respectively.

While I have described my invention in connection with a specific embodiment thereof, it is to be clearly understood that this is done only by way of example and not as a limitation to the scope of my invention as set forth in the objects thereof and in the appended claims.

I claim:

1. A liquid intensifier unit, comprising:

a plurality of elongate, liquid intensifiers; and first means fixing said intensifiers together in juxtaposition; wherein each of said intensifiers has a first, common opening at one end thereof for both admitting thereinto, and discharging therefrom, respectively, an operating, low-pressure fluid;

each of said intensifiers further has a second, common opening at the other, opposite end thereof for both admitting thereinto, and discharging therefrom, respectively, a subject liquid for pressure intensification of such liquid by such each intensifier;

each of said intensifiers also has a given, variable volume chamber formed therewithin for receiving therewithin, and expelling therefrom, an operating liquid; and further including second means effecting a common, fluid communication of said given, variable-volume chambers only with each other, for conducting operating liquid, expelled from such a given, variable-volume chamber of one of said intensifiers, to said given, variable-volume chamber of another of said intensifiers; and valving means, coupled to said intensifiers for admitting an operating, low-pressure fluid to, and for discharging the same, said, low-pressure fluid from, said first, common opening of each of said intensifiers, in turn, and repetitively; wherein each of said intensifiers further has a low-pressure piston therewithin movable in first and second, opposite directions;

said valving means and said second means comprise means cooperative for moving one of said low-pressure pistons, in one of said intensifiers, in one of said first and second directions, at a given acceleration in response to a movement of another low-pressure piston, in another of said intensifiers, in the other of said first and second directions, at a differing acceleration;

said first means comprises a base plate;

said base plate has a given plurality of channels formed therein;

each of said channels has a pair of ports, formed in, and opening externally of, said plate, in communication therewith;

an aperture formed in said plate, and opening both externally and internally of said plate; and ends of each of said channels are in fluid-flow communication with said aperture.

2. A liquid intensifier unit, according to claim 1, wherein:

said second, common opening of each of said intensifiers, is nestably engaged with one of said ports of one of said pairs thereof.

3. A liquid intensifier unit, according to claim 2, further including:

means interposed in each of said channels for prohibiting a conduct of liquid (a) from one of said ports of any pair thereof to the other of said ports of such pair, and (b) from said aperture to any of said ports.

* * * * *